United States Patent [19]

Takatsu

[11] Patent Number: 4,850,148

[45] Date of Patent: Jul. 25, 1989

[54] METHOD OF AND APPARATUS FOR POLISHING A FIBER

[75] Inventor: Matsuo Takatsu, Nagaoka, Japan

[73] Assignee: Tokki Corporation, Tokyo, Japan

[21] Appl. No.: 200,153

[22] Filed: May 31, 1988

[30] Foreign Application Priority Data

Jul. 7, 1987 [JP] Japan ..... 62-168976

[51] Int. Cl.[4] ..... B24B 29/08

[52] U.S. Cl. ..... 51/73 R; 51/140; 51/357; 51/283 R; 51/328; 51/16

[58] Field of Search ..... 51/73 R, 72 R, 71, 140, 51/16, 357, 394, 283 R, 328; 15/104.04

[56] References Cited

U.S. PATENT DOCUMENTS 513,880 1/1894 Clark et al. ..... 51/140
978,497 12/1910 Simon ..... 51/140
2,994,163 8/1961 Schulze ..... 51/73

FOREIGN PATENT DOCUMENTS 1017936 10/1957 Fed. Rep. of Germany ..... 51/140
2906238 8/1980 Fed. Rep. of Germany .... 51/283 R
0023548 2/1979 Japan ..... 51/73 R

*Primary Examiner*—Frederick R. Schmidt
*Assistant Examiner*—Robert A. Rose
*Attorney, Agent, or Firm*—Fulbright & Jaworski

[57] ABSTRACT

A method of polishing a fiber, which is particularly difficult to rotate 360 degrees in its polishing operation, comprises the steps of: bringing a thread-like polishing medium into contact with an outer peripheral portion of the fiber; and moving axially and rotatably the thread-like polishing medium relative to the outer peripheral portion of the fiber; whereby the fiber is polished with the thread-like polishing medium.

6 Claims, 3 Drawing Sheets

METHOD OF AND APPARATUS FOR POLISHING A FIBER

BACKGROUND OF THE INVENTION

1. Field of the Invention

The present invention relates to a method of and an apparatus for polishing a fiber. According to the present invention, deposits such as silicon and the like adhered to a fiber, for example such as the bare fiber or core of an optical fiber is removed when the core of the optical fiber is polished.

2. Description of the Prior Art

The optical fibers are employed in various industrial fields, and remarkably widespread among them.

Each of the optical fibers consists mainly of: its core a diameter of which is on the order of 0.1 mm; and a cladding member with which the core of the optical fiber is covered. Consequently, in the case of splicing the optical fibers, the optical fibers to be joined are stripped of their protective coating or cladding members over predetermined lengths from their ends so as to prepare their joining ends, and after that the thus prepared ends are polished to remove the deposits such as silicon and the like.

Hitherto, in the case of polishing the core of the optical fiber, since as shown in FIG. 1 it is difficult to hold the optical fiber 1 and since the fiber 1 is very brittle to make it difficult to rotate the fiber 360 degrees on its axis, the core 3 of the fiber 1 is intermittently rotated up to 180 degrees on its axis while sandwiched between cloths 2 in which a suitable polishing agent or wiping solvent such as alcohol and the like has been absorbed. Under such circumstances, the cloths 2 are axially moved relative to the core 3 of the optical fiber 1 to wipe and polish the core 3.

Such conventional polishing work of the core 3 of the optical fiber 1 is conducted manually or mechanically. However, since it is hard to hold the optical fiber 1, the conventional polishing work of the core 3 of the fiber 1 takes much time and labor to impair workability and productivity in mass production. In addition, the conventional polishing work is also disadvantageous in that it is completely difficult to polish the base of the core 3 of the optical fiber 1.

SUMMARY OF THE INVENTION

It is an object of the present invention to provide a method of polishing in a short time a fiber such as an optical fiber which is difficult to rotate 360 degrees, in an easy manner.

It is another object of the present invention to provide an apparatus for working the above method of the present invention.

The above first object of the present invention is accomplished by providing:

A method of polishing a fiber comprising the steps of:

bringing a thread-like polishing medium into contact with an outer peripheral portion of the fiber; and moving axially and rotatably the thread-like polishing medium relative to the outer peripheral portion of the fiber;

whereby the fiber is polished with the thread-like polishing medium.

In the method of the present invention, since the thread-like polishing medium is axially and rotatably moved relative to the fiber as described above, it is possible to easily polish in a short time the fiber such as the optical fiber which is difficult to rotate 360 degrees.

The above another object of the present invention is accomplished by providing:

An apparatus for polishing a fiber comprising:

a hollow rotary shaft disposed in a polishing position of the fiber, the hollow rotary shaft being rotatably driven by a driving unit and provided with: a medium-entrance opening at its one end, through which medium-entrance opening the thread-like polishing medium enters the hollow rotary shaft; and a medium-exit opening at the other end thereof, through which medium-exit opening the thread-like polishing medium is discharged from the hollow rotary shaft;

an unwind-bobbin assembly for supplying the thread-like polishing medium to the fiber, the unwind-bobbin assembly being provided with a sufficient amount of the thread-like polishing medium and coaxially and fixedly mounted on the hollow rotary shaft; and a wind-up bobbin for receiving the thread-like polishing medium having been supplied from the unwind-bobbin assembly through the medium-entrance and -exit openings of the hollow rotary shaft, the wind-up bobbin being rotatably driven by the driving unit or by another driving unit so that the thread-like polishing medium having been supplied from the unwind-bobbin assembly is wound on the wind-up bobbin;

whereby the fiber having been inserted into the interior of the hollow rotary shaft through the medium-entrance opening or the medium-exit opening of the hollow rotary shaft is polished at its outer peripheral portion with the thread-like polishing medium moved axially and rotatably relative to the fiber.

In the apparatus of the present invention, the thread-like polishing medium supplied from the unwind-bobbin assembly is transferred through the interior of the hollow rotary shaft while rotatably driven by the hollow rotary shaft so as to be wound around the wind-up bobbin, whereby the outer peripheral portion of the fiber is polished with the thread-like polishing medium moved axially and rotatably relative to the fiber. As described above, in the apparatus of the present invention, it is possible to polish the outer peripheral portion of the fiber by simply inserting the fiber into the hollow rotary shaft of the apparatus through the medium-entrance opening or the medium-exit opening of the hollow rotary shaft, namely, at this time, it is not required to rotate the fiber itself to any extent during the polishing operation thereof.

DESCRIPTION OF THE PREFERRED EMBODIMENTS

Figure 1:
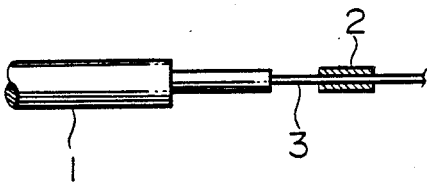
FIG. 1 is a view illustrating a conventional method of polishing the fiber.
Figure 2:
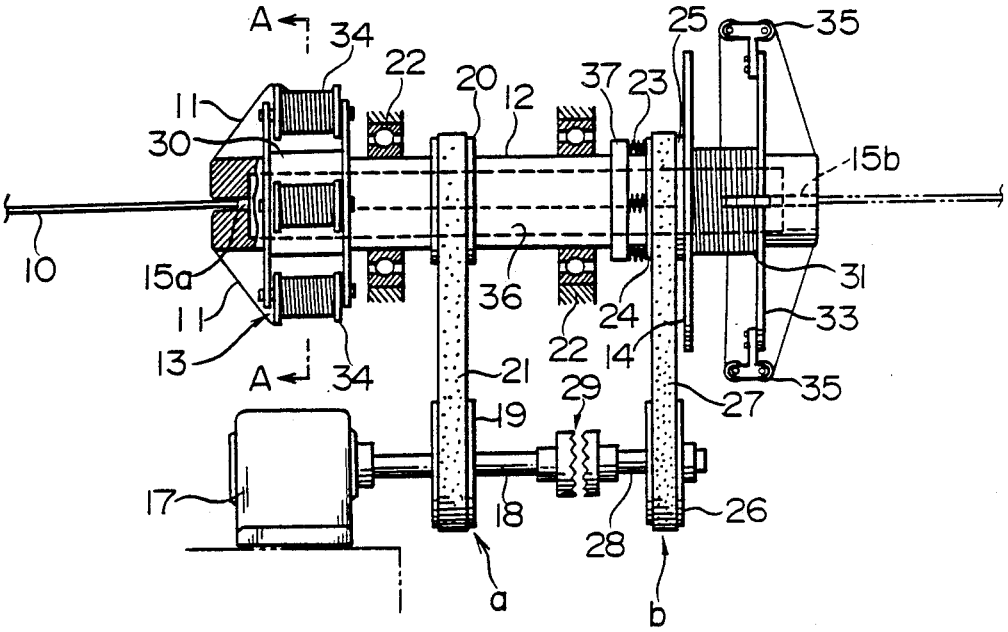
FIG. 2 is a partially sectional front view of an embodiment of the apparatus of the present invention.
Figure 3:
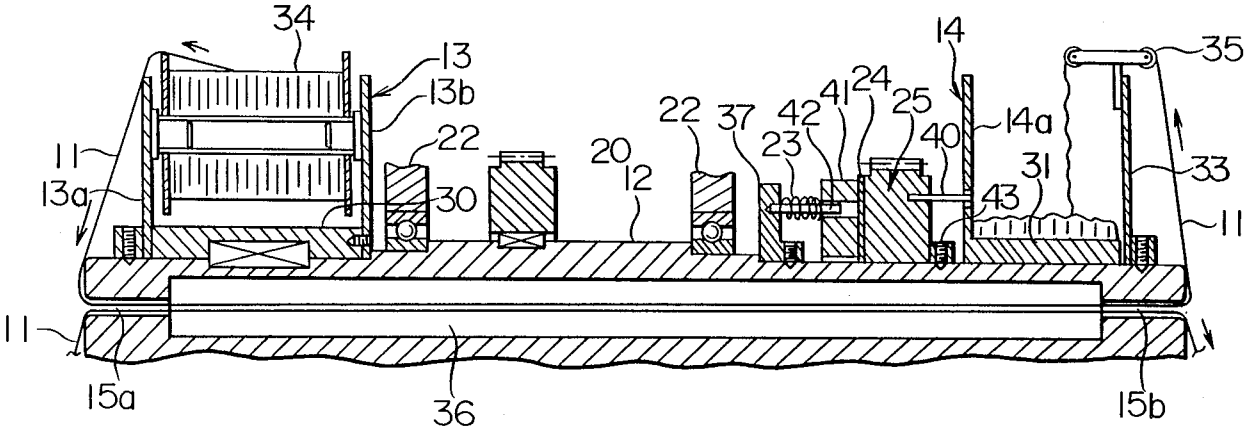
FIG. 3 is a longitudinal sectional view of an upper half of the hollow rotary shaft assembly of the apparatus of the present invention shown in FIG. 2.
Figure 4:
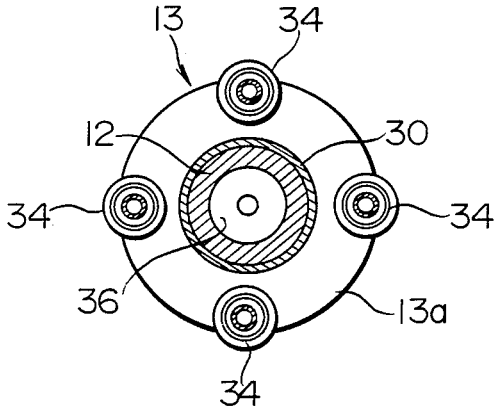
FIG. 4 is a cross-sectional view of the unwind-bobbin assembly of the apparatus of the present invention, taken along the line A—A of FIG. 2.
Figure 5:
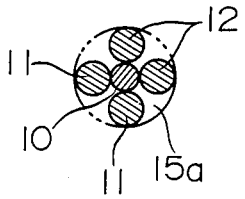
FIG. 5 is a cross-sectional view of the fiber to be polished in the apparatus of the present invention shown in FIG. 2, for illustrating the relationship between the fiber and the thread-like polishing mediums during the polishing operation conducted in the apparatus of the present invention.

An apparatus of the present invention for polishing a fiber such as the core of an optical fiber is shown in FIGS. 2 and 3 in which the reference numeral 12 denotes a hollow rotary shaft provided with: a medium-entrance opening 15*a* at its one end, through which opening 15*a* a thread-like polishing medium 11 enters the interior of the hollow rotary shaft 12; and a medium-exit opening 15*b* at the other end thereof, through which opening 15*b* the thread-like polishing medium 11 is discharged from the interior of the hollow rotary shaft 12.

The hollow rotary shaft 12 is supported by bearing portions 22, and driven by a suitable driving unit "a".

As shown in FIG. 2, the driving unit "a" consist of: a motor 17 having an output shaft 18 on which is fixedly mounted an output pulley 19. An endless belt 21 runs round the output pulley 19 and an input pulley 20 fixedly mounted the hollow rotary shaft 12 to transmit torque from the output shaft 18 to the hollow rotary shaft 12 through the endless belt 21.

An unwind-bobbin assembly 13 is coaxially and fixedly mounted on the hollow rotary shaft 12 in the vicinity of the medium-entrance opening 15*a* thereof. The unwind-bobbin assembly 13 is provided with: a pair of flanges 13*a*, 13*b* which are axially and oppositely disposed from each other through an axial barrel portion 30; and a plurality of unwind bobbins 34 on each of which a sufficient amount of the thread-like polishing medium is wound, the unwind bobbins 34 being so rotatably mounted between the flanges 13*a*, 13*b* that they are substantially parallel to the axial barrel portion 30 and spaced apart from each other in a circumferential direction of the hollow rotary shaft 12.

A wind-up bobbin 14 is coaxially and rotatably mounted on the hollow rotary shaft 12 in the vicinity of the medium-exit opening 15*b* thereof. The wind-up bobbin 14 is provided with an axial barrel portion 31 an end of which forms a flange 14*a* which cooperates with another flange 33 in the winding operation of the thread-like polishing medium to prevent the thread-like polishing medium from dropping out of the axial barrel portion 31 of the wind-up bobbin 14. Such another flange 33 is fixedly mounted on the hollow rotary shaft 12 as is clear from FIG. 3.

The wind-up bobbin 14 is connected to the driving unit "a" through a rotation-control mechanism "b" as shown in FIG. 2. The rotation-control mechanism "b" is provided with a clutch 29 for coupling or uncoupling the output shaft 18 of the motor 17 and an output shaft 28 of an output pulley 26. An endless belt 27 runs round the output pulley 26 and an input pulley 25 which is rotatably mounted on the hollow rotary shaft 12. On the other hand, as shown in FIG. 3, the input pulley 25 is connected with the wind-up bobbin 14 through a plurality of axial pins 40 which are spaced apart from each other in a circumferential direction of the wind-up bobbin 14. Consequently, in the apparatus of the present invention having the above construction: torque is transmitted from the output shaft 28 to the wind-up bobbin 14 through the endless belt 27; and both of the ratios of the output pulley 26 to the input pulley 25 and of the output pulley 19 to the input pulley 20 in diameter are so determined that, in the coupling ( or normal running) position of the clutch 29, the rotational speed of the wind-up bobbin 14 is larger that that of the hollow rotary shaft 12.

Incidentally, in the apparatus of the present invention, it is also possible to allow the rotational speed of the wind-up bobbin 14 to be smaller than that of the hollow rotary shaft 12, whereby the thread-like polishing medium 11 is wound on the wind-up bobbin 14 in a direction reverse to that of the above case.

As shown in FIG. 3, a flange 37 is fixedly mounted on the hollow rotary shaft 12 in the vicinity of the input pulley 25. A pressing ring 41 is slidably mounted on the hollow rotary shaft 12 in a position between the flange 37 and the input pulley 25, while slidably connected with the flange 37 through a plurality of axial pins 42 arranged in a circumferential direction of the flange 37. On each of the axial pins 42 is mounted a compression spring 23. Under the influence of the resilient force of the compression spring 23, the pressing ring 41 is spring pressed against the input pulley 25. As shown in FIG. 3, a friction disk 24 is sandwiched between surfaces of the pressing ring 41 and the input pulley 25, which surfaces are oppositely disposed from each other.

An axial sliding motion of the input pulley 25 is restricted by a stop ring 43 as shown in FIG. 3. When the motor 17 is actuated and the clutch 29 is in the coupling (or normal running) position, the input pulley 25 is rotatably driven at a rotational speed larger or smaller than that of the hollow rotary shaft 12 against the frictional resistance caused by the friction disk 24. On the other hand, when the clutch 29 is in the uncoupling position thereof, the input pulley 25 is prevented from freely rotating under the influence of the frictional resistance of the friction disk 24 so that the input pulley 25 rotates at the same rotational speed as that of the hollow rotary shaft 12.

In case that detergents are supplied to the fiber 10, the detergents are ejected to the medium-entrance opening 15*a* of the hollow rotary shaft 12 from the outside. It is also possible to provide a polishing-agent reservoir 36 in the interior of the hollow rotary shaft 12, in which reservoir 36 is received a suitable liquid polishing agent such as alcohol, lapping compounds and the like to make it possible to always supply the polishing agent to the thread-like polishing medium 11 and thus to the fiber 10.

In case that the polishing agent is liquid, it is preferable that such liquid polishing agent is absorbed in a suitable absorbent such as a cloth.

Preferably, the thread-like polishing medium is constructed of cotton yarn which is excellent in both of liquid-absorption capacity and tensile strength.

Now, hereinbelow will be described in detail how to operate the apparatus of the present invention having the above construction.

At first, the thread-like polishing mediums 11 wound on the unwind bobbins 34 of the unwind-bobbin assembly 13 are inserted into the interior of the hollow rotary shaft 12 through the medium-entrance opening 15*a* thereof, and passed through the interior of the hollow rotary shaft 12 and its medium-exit opening 15*b* so as to be discharged from the hollow rotary shaft 12. The thus discharged thread-like polishing mediums 11 are wound on the wind-up bobbin 14 firmly through guide rollers 35 which are rotatably mounted on the flange 33.

Then, the motor 17 is actuated, and the clutch 29 is coupled so that the unwind-bobbin assembly 13 is rotated together with the hollow rotary shaft 12. At this time, the wind-up bobbin 14 is also rotated on the axis of the hollow rotary shaft 12 at a rotational speed larger or smaller than that of the hollow rotary shaft 12 to cause the wind-up bobbin 14 to wind the thread-like polishing mediums 11 ( which are transferred in the direction of the arrow shown in FIG. 3) thereon. Under such circumstances, the fiber 10 to be polished is inserted into the interior of the hollow rotary shaft 12 through the medium-entrance opening 15*a* or the medium-exit opening 15*b* of the hollow rotary shaft 12. As a result, the thread-like polishing mediums 11 are axially and rotatably moved relative to the fiber 10 so that the outer peripheral portion of the fiber 10 is sufficiently polished with the thread-like polishing mediums 11.

After that, the clutch 29 is uncoupled so that, under the influence of the frictional resistance of the friction disk 24, the wind-up bobbin 14 is rotated at the same rotational speed as that of the hollow rotary shaft 12. Consequently, in this state, the thread-like polishing mediums 11 are not transferred in the direction of the arrow shown in FIG. 3. Under such circumstances, the thread-like polishing mediums 11 are moved only rotatably relative to the fiber 10 to polish the same.

In general, at the beginning stage of the polishing operation, since a relatively large amount of deposits adheres to the fiber 10, it is necessary for the thread-like polishing mediums 11 to combine their rotational movements with their axial movements in order to accomplish a sufficient polishing operation of the fiber 10. However, in the next stage of the polishing operation following the above beginning stage, it is preferably to conduct the polishing operation only by the use of the rotational movements of the thread-like polishing mediums 11. Incidentally, it is entirely in the operator's discretion whether he combines the rotational movements of the thread-like polishing mediums 11 with their axial movements in the next stage of the polishing operation following the beginning stage.

As is clear from FIG. 2, it is also possible to polish the fiber 10 with the thread-like polishing mediums 11 in the medium-exit opening 15*b* of the hollow rotary shaft 12.

What is claimed is:

1. An apparatus for polishing a fiber comprising:

a hollow rotary shaft disposed in a polishing position of said fiber, said hollow rotary shaft being rotatably driven by a driving unit and provided with: a medium-entrance opening at its one end, through which medium-entrance opening said thread-like polishing medium enters said hollow rotary shaft; and a medium-exit opening at the other end thereof, through which medium-exit opening said thread-like polishing medium is discharged from said hollow rotary shaft;

an unwind-bobbin assembly for supplying said thread-like polishing medium to said fiber, said unwind-bobbin assembly being provided with a sufficient amount of said thread-like polishing medium and coaxially and fixedly mounted on said hollow rotary shaft; and a wind-up bobbin for receiving said thread-like polishing medium having been supplied from said unwind-bobbin assembly through said medium-entrance and -exit openings of said hollow rotary shaft, said wind-up bobbin being rotatably driven by said driving unit or by another driving unit so that said thread-like polishing medium having been supplied from said unwind-bobbin assembly is wound on said wind-up bobbin;

whereby said fiber having been inserted into said interior of said hollow rotary shaft through said medium-entrance opening or said medium-exit opening of said hollow rotary shaft is polished at its outer peripheral portion with said thread-like polishing medium moved axially and rotatably relative to said fiber.

2. The apparatus for polishing the fiber as set forth in claim 1, wherein: a plurality of unwind bobbins on each of which a sufficient amount of said thread-like polishing medium is wound are so provided between a pair of flanges of said unwind-bobbin assembly that they are spaced apart from each other in a circumferential direction of said unwind-bobbin assembly to make it possible to supply a plurality of said thread-like polishing mediums to said fiber being polished; and said plurality of said thread-like polishing mediums are simultaneously wound on said wind-up bobbin.

3. The apparatus for polishing the fiber as set forth in claim 1, wherein: said hollow rotary shaft. rotatably mounted on said hollow rotary shaft.

4. The apparatus for polishing the fiber as set forth in claim 3, wherein: a rotation-control mechanism is provided between said wind-up bobbin and its driving unit.

5. The apparatus for polishing the fiber as set forth in claim 4, wherein:

said rotation-control mechanism is rotatably provided in said hollow rotary shaft; and said rotation-control mechanism is constructed of: an input wheel; an output wheel engaged with said input wheel, said output wheel being provided with an output shaft; and a clutch means for coupling or uncoupling said output shaft of said output wheel and an output shaft of said driving unit.

6. The apparatus for polishing the fiber as set forth in claim 4, wherein: a pressing ring is axially movably mounted on said hollow rotary shaft; a spring means for pressing one side of said pressing ring against said input wheel is provided between the other side of said pressing ring and a flange fixed to said hollow rotary shaft; and a friction disk is provided between said pressing ring and said input wheel.

* * * * *

UNITED STATES PATENT OFFICE

CERTIFICATE OF CORRECTION

Patent No. 4,850,148 Dated July 25, 1989

Inventor(s) Matsuo Takatsu

It is certified that error appears in the above-identified patent and that said Letters Patent is hereby corrected as shown below:

Column 6, line 32, delete "hollow rotary shaft" and insert -- wind-up bobbin is --

Signed and Sealed this

Fifth Day of June, 1990

*Attest:*

HARRY F. MANBECK, JR.

*Attesting Officer*

*Commissioner of Patents and Trademarks*